United States Patent [19]

Duke

[11] 3,947,900

[45] Apr. 6, 1976

[54] COMBINATION COMMODE CONSTRUCTION

[76] Inventor: James I. Duke, 9851 Bellefontaine, St. Louis, Mo. 63137

[22] Filed: Dec. 16, 1974

[21] Appl. No.: 532,777

[52] U.S. Cl. ..... 4/11; 4/67 R; 4/67 A; 4/97

[51] Int. Cl.[2] .... E03D 1/22; E03D 3/00; E03D 3/12

[58] Field of Search ..... 4/11, 10, 97, 91, 117, 4/118, 67 R, 67 A

[56] References Cited

UNITED STATES PATENTS

| | | | |
|---|---|---|---|
| 340,121 | 4/1886 | Hyde | 4/91 X |
| 560,740 | 5/1896 | McCartney | 4/91 |
| 644,488 | 2/1900 | Adams | 4/91 |
| 1,027,342 | 5/1972 | Kammer | 4/91 |
| 3,336,602 | 8/1967 | Kubit | 4/97 |

FOREIGN PATENTS OR APPLICATIONS

| | | | |
|---|---|---|---|
| 311,845 | 4/1919 | Germany | 4/11 |

*Primary Examiner*—Henry K. Artis
*Attorney, Agent, or Firm*—Charles B. Haverstock

[57] ABSTRACT

A combination commode construction having a water closet common to more than one commode, and separate control means on the water closet for individually flushing each of the separate commodes, said separate flushing means including means to control the amount of flush water used in the flushing of each commode.

7 Claims, 5 Drawing Figures

COMBINATION COMMODE CONSTRUCTION

It has been common practice to provide a water closet in association with a commode and to include on the water closet means for flushing the commode. It is also known to construct different size commodes including standard size commodes for adult use and smaller sizes for infants and children. In the case of the smaller sized commodes however it may not always be desired to provide separate controls and separate water closets and it may not be desired to use as much flush water to flush a small commode as to flush a regular sized comode. However, there is a need in homes as well as in public places to provide different sized facilities and in such cases it is often preferred for various reasons including available space to use the same water closet to supply the flush water for flushing the different commodes that may be available. The present invention teaches the construction and operation of a combination construction wherein the same water closet is used to provide the flush water for flushing two or more different commodes, said water closet having separate controls which enable individually and selectively flushing each of the different commodes. In this way the present construction is able to conserve water and will do so without requiring substantial additional equipment or taking up much additional space and by means which require a minimum of additional equipment most of which is readily available.

It is therefore a principal object of the present invention to conserve water used in the flushing of commodes.

Another object is to provide means to separately control the flushing of different commodes using the same water closet.

Another object is to minimize the space required in a bathroom or public toilet to accommodate more than one commode including the possibility of commodes of different sizes.

Another object is to make it relatively simple and inexpensive to add a separate commode such as a childs commode in association with an existing commode.

Another object is to be able to use known and readily available components to modify an existing water closet construction to enable it to be used to flush different commodes having the same or different water flushing requirements.

Another object is to increase the versatility and flexibility of existing water flushing equipment without substantially increasing the amount of equipment required.

Another object is to make it relatively simple and inexpensive to install additional commodes as required and to make the removal thereof also relatively simple and with minimum structural changes.

These and other objects and advantages of the present invention will become apparent after considering the following detailed specification which discloses a preferred form of the present device in conjunction with the accompanying drawing wherein.

Figure 1:
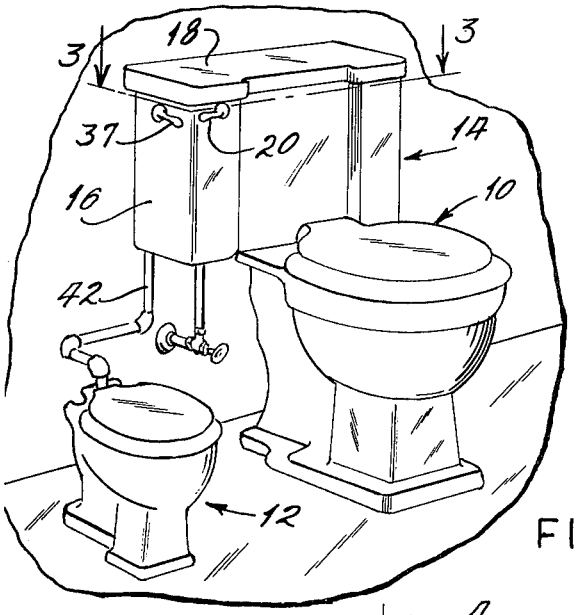
FIG. 1 is a perspective view showing an arrangement of several commodes connected to a common source of flushing water.

Referring to the drawing more particularly by reference numbers, number 10 in FIG. 1 refers to a commode such as a regular type commode commonly found in houses and public restrooms. Number 12 refers to a second commode shown as a miniature size commode similar in construction to the commode 10 but smaller in size to accommodate children. Associated with the commodes 10 and 12 is a water closet 14 which has some features which are more or less conventional and other features which modify its construction. The water closet 14 includes a housing 16, a lid 18, and a control handle or lever 20 which is used to control the flushing of a commode 10 in a usual manner.

Figure 3:
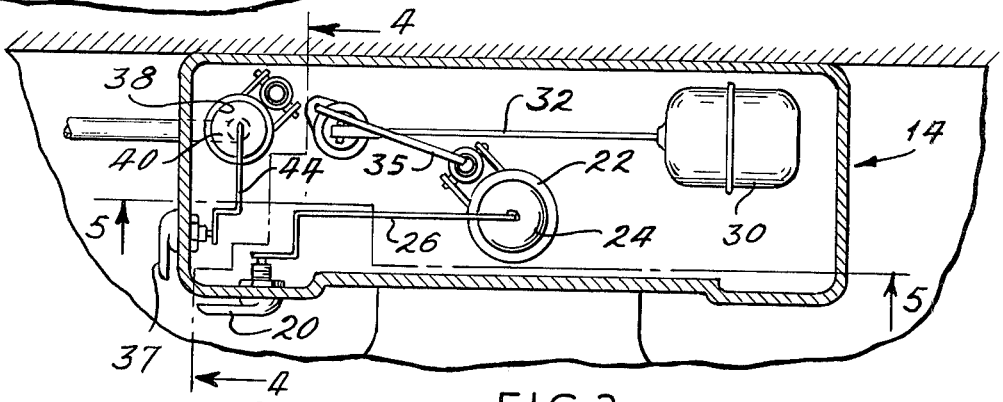
FIG. 3 is a cross-sectional view taken on line 3—3 of FIG. 1.
Figure 4:
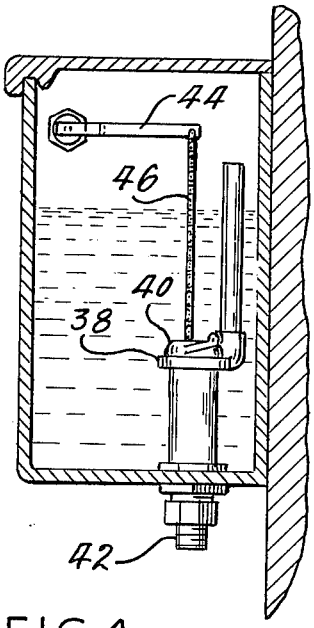
FIG. 4 is a cross-sectional view taken on line 4—4 of FIG. 3.
Figure 5:
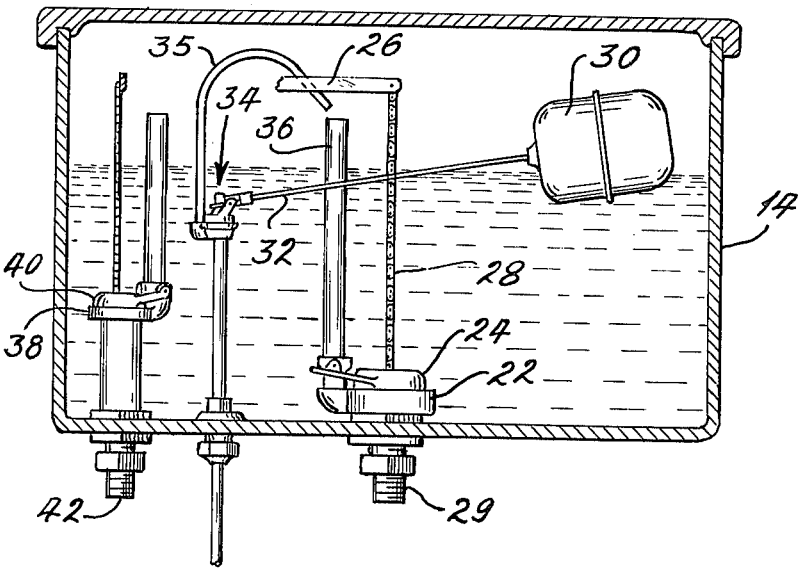
FIG. 5 is a cross-sectional view taken on line 5—5 of FIG. 3.

In the construction shown in FIG. 1 the larger commode 10 receives its flushing water from the water closet 14 through an outlet valve port associated with valve seat 22 (FIGS. 3 and 5), and valve means 24 cooperate with the valve seat 22 during a flushing operation by moving between an open and a closed condition relative thereto under control of the operating lever 20, the connecting arm 26, and connecting means shown as chain 28. The chain 28 is connected between the free end of the arm 26 and the movable valve member 24. When the operating lever 20 is actuated and opens the valve seat 22, the water in the water closet 14 will pass out through the outlet port 22 into the pipe 29 and into the commode 10 in the usual manner. The amount of water that is used to flush the commode 10 is controlled by the location or elevation of the outlet port or valve seat 22 in the tank 14 and the capacity of the tank. When a flushing operation has been completed and all or nearly all of the water in the tank 14 has escaped through the outlet port 22, float means 30 which are mounted on the end of control rod 32 will have fallen to a lowered position from that shown in FIG. 5. This will operate to open water control valve means 34 to cause water to be fed into the water closet 14 through tube 35 which has its outlet end directed into the upper end of overflow stack 36. This will continue until the valve means 34 are reclosed by operation of the float 30 in rising on the water surface to a predetermined level as the tank is being refilled.

The present construction has a second operation lever 37 which controls the flushing of the commode 12. The lever 37 is also mounted on the water closet 14 but is shown mounted on one end thereof instead of on the front wall. The operating lever 37 is associated with a second outlet port or valve seat 38 which is controlled by a second outlet valve 40 similar to the valve member 24. The outlet seat 38 is positioned to be at an elevation in the tank when used to flush a child's commode that is about a third of the way up on the overflow stack 36, and the outlet seat 38 communicates with another water outlet pipe 42 attached to the bottom of the water closet 14. The pipe 42 extends from the tank to its opposite end which is connected to the flush water inlet of the smaller commode 12 as clearly shown in FIG. 1.

When the operating lever 37 is actuated another lever arm 44 which is connected by another chain 46 to the valve means 40 will be pivoted. This will move the valve member 40 upwardly away from the valve seat 38 thereby opening the valve associated with the smaller commode 12 so that the flush water contained in the tank 14 can escape through the outlet pipe 42 and enter the commode 12 for flushing purposes. As indicated the elevation of the valve seat 38 for the smaller commode 12 is located at a different elevation in the water closet 14 than the valve seat 22 used for flushing the larger commode. This means that when the smaller commode 12 is flushed less flush water will escape from the tank and be used and this is an important advantage since is saves water. On the other hand it is also contemplated to apply the principles of the present construction to a situation where two or more regular size commodes are to be operated from the same tank. This may be desirable in certain situations including in public toilets and if this is done the same principles apply, that is where two or more commodes are to be operated off of a common tank the amount of flush water can be made to be the same or can be made to be different for the different commodes, as desired.

Figure 2:
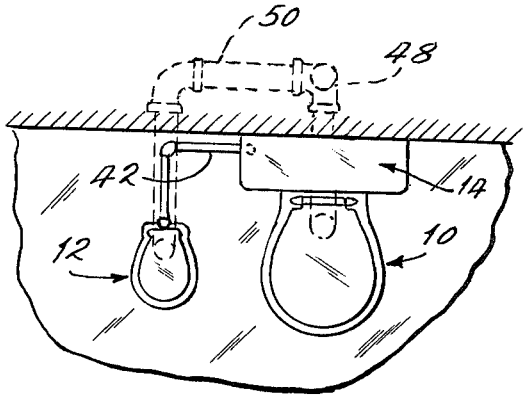
FIG. 2 is a top plan view of the means shown in FIG. 1.

In FIG. 2 the two commodes 10 and 12 are shown having outlets which are connected to discharge into a common sewer line 48. The outlet pipe 48 is shown connected directly to the outlet of the larger commode 10 and a branch pipe 50 is shown connected between the outlet of the smaller commode 12 and the sewer line 48 to complete the installation.

It is apparent from what has been said that the present construction is adaptable to many different situations including situations in home bathrooms as well as situations in public toilets. It is also apparent that the subject construction lends itself to ease of installation, and the subject improvements can also be disconnected and removed if the need for a second commode no longer exists. Furthermore, this can be done with minimum of change to the existing structure and with a minimum of repair and reconditioning to the room in which the installation is made. For example all that is required to remove the child's commode 12 is to disconnect and seal the opening for the pipe 42, remove the small commode, plug the sewer outlet with a suitable closure means such as with a flat lid clean out ferrule which may be required for sanitary reasons, cover over the closed sewer outlet with a rug or other suitable floor cover, and if desired remove the operating lever 37 and the associated components which are controlled thereby. The hole in the water closet left by removal of the lever 37 can also be plugged if desired.

Thus there has been shown and described a novel and useful means whereby a simple water closet and associated controls can be used to supply flush water to two or more commodes, which means fulfill all of the objects and advantages sought therefor. It will be apparent to those skilled in the art however, that many changes, modifications, variations and other uses and applications for the subject means are possible and contemplated, and all such changes, modifications, variations and other uses and applications thereof which do not depart from the spirit and scope of the invention are deemed to be covered by the invention which is limited only by the claims which follow.

What is claimed is:

1. A water closet construction adapted to service a plurality of distinct and spaced flush type toilet commodes which may have different flush water requirements comprising a water tank having a first outlet for communicating with a first toilet commode, a second outlet for communicating with a second toilet commode, said second outlet being displaced on said tank from said first outlet to permit each of said outlets to be individually and separately communicatively connected to its respective toilet commode, first valve means associated with the first outlet including means for moving the first valve means relative to the first outlet to flush the first toilet commode independently of said second toilet commode with water from the water tank, said first valve means including means for controlling the quantity of water discharged from the water tank to the first toilet commode, second valve means associated with the second outlet including means for moving the second valve means relative to the second outlet to flush the second toilet commode independently of said first toilet commode with water from the water tank, said second valve means including means for controlling the quantity of water discharged from the water tank through the second outlet to said second toilet commode, and means to refill the water tank to a predetermined water level after each flushing operation.

2. A water closet comprising a tank having a first outlet, a second outlet, means for connecting the first outlet to a first toilet unit, means for connecting the second outlet to a second toilet unit physically distinct and spaced from said first toilet unit, a first valve seat associated with the first outlet and located in the tank at a predetermined elevation, a second valve seat associated with the second outlet and located in the tank at a different elevation than the first valve seat, first valve means associated with the first valve seat to control the flow of water from the tank to the first outlet, said first valve means including first actuator means operable to open the first valve seat to discharge water to the first outlet to individually flush the first toilet unit, second valve means associated with the second valve seat to control the flow of water from the tank to the second outlet, said second valve means including second actuator means operable to open the second valve seat to discharge water to the second outlet to individually flush the second toilet unit, and means to refill the water tank to a predetermined level after each flushing regardless of whether the first or second toilet unit is flushed.

3. The water closet defined in claim 2 including a first operator actuatable lever mounted on the water tank, means operatively connecting said first lever to the first valve means to enable said first lever to be used to actuate said first valve means, a second operator actuatable lever mounted on the water tank, means operatively connecting said second lever to the second valve means to enable said second lever to be used to actuate said second valve means, said means for refilling the water tank to be predetermined elevation including an inlet water line and water valve means associated therewith, and float means operatively connected to said water valve means to control the opening and closing thereof in response to the amount of water in the tank.

4. A combination toilet assembly comprising a first commode, a second commode physically distinct and spaced from said first commode, each of said commodes being separately and independently flushable, and a water closet for containing water for separately and independently flushing each of the first and second commodes, said water closet having a first outlet, means for connecting said first outlet to the first commode, a second outlet, means for connecting said second outlet to the second commode, a first valve seat associated with the first outlet and located in the tank at a predetermined elevation, first valve means associated with the first valve seat to separately and independently control the flow of water from the tank through the first outlet and to the first commode, a second valve seat associated with the second outlet and located in the tank at a predetermined elevation, second valve means associated with the second valve seat to separately and independently control the flow of water from the tank through the second outlet to the second commode, first actuator means including means mounted on the outside of the tank, means operatively connecting said first actuator means to the first valve means to control the opening and closing thereof and the discharge of water to the first outlet, second actuator means including means mounted on the outside of the tank, means connecting said second actuator means to the second valve means to control the opening and closing thereof and the discharge of water to the second outlet, and means to refill the tank to a predetermined level after each actuation of the first or second actuator means.

5. The combination set forth in claim 4 wherein the first and second commodes are of different sizes, and wherein the first valve seat is at a different elevation in the tank than the second valve seat.

6. The combination set forth in claim 4 including means forming a common sewer connection for the discharge of the first and second commodes.

7. The combination set forth in claim 4 wherein said means to refill the tank include a single inlet water line, valve means associated with the water line, and float means operatively connected to the water valve means to control the opening and closing thereof in response to the quantity of water contained in the tank and to control the refilling of the tank after each flushing operation.

* * * * *